US012208443B2

(12) United States Patent
Huang et al.

(10) Patent No.: US 12,208,443 B2
(45) Date of Patent: Jan. 28, 2025

(54) HEAT EXTRACTION OR RETENTION DURING DIRECTIONAL SOLIDIFICATION OF A CASTING COMPONENT

(71) Applicant: General Electric Company, Schenectady, NY (US)

(72) Inventors: Shenyan Huang, Niskayuna, NY (US); Christopher Raymond Hanslits, Simpsonville, SC (US); Canan Uslu Hardwicke, Greenville, SC (US); Jared Micheal Iverson, Tremonton, UT (US); Jon Conrad Schaeffer, Greenville, SC (US)

(73) Assignee: GE Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 18/466,327

(22) Filed: Sep. 13, 2023

(65) Prior Publication Data

US 2024/0075523 A1 Mar. 7, 2024

Related U.S. Application Data

(63) Continuation of application No. 17/939,317, filed on Sep. 7, 2022, now Pat. No. 11,833,581.

(51) Int. Cl.
*B22D 27/04* (2006.01)

(52) U.S. Cl.
CPC ..... *B22D 27/045* (2013.01)

(58) Field of Classification Search
CPC ..... B22D 15/00; B22D 27/04; B22D 27/045
USPC ..... 164/338.1, 348, 361, 256, 258, 122.1, 164/122.2, 125, 126, 127, 128
See application file for complete search history.

(56) References Cited

U.S. PATENT DOCUMENTS

| | | | | |
|---|---|---|---|---|
| 5,921,310 | A | 7/1999 | Kats et al. | |
| 6,217,286 | B1 | 4/2001 | Huang et al. | |
| 6,244,327 | B1 | 6/2001 | Frasier | |
| 11,833,581 | B1 * | 12/2023 | Huang et al. ..... | B22D 27/045 |
| 2013/0022803 | A1 | 1/2013 | Schaeffer et al. | |
| 2017/0216912 | A1 | 8/2017 | Tennant et al. | |
| 2018/0193906 | A1 | 7/2018 | Grange et al. | |

FOREIGN PATENT DOCUMENTS

| | | | |
|---|---|---|---|
| EP | 1946868 | A1 | 7/2008 |
| JP | 2013163200 | A | 8/2013 |

OTHER PUBLICATIONS

International Search Report Corresponding to Application No. PCT/US2023/073324 on Dec. 28, 2023.

* cited by examiner

*Primary Examiner* — Kevin P Kerns
(74) *Attorney, Agent, or Firm* — Dority & Manning, P.A.

(57) ABSTRACT

A method of forming a directionally-solidified casting component using a casting system is provided. The casting system includes a chamber having a heating zone and a cooling zone separated by a baffle plate. The method includes pouring an alloy in a liquid state into a mold shell. The mold shell is positioned on a chill plate within the heating zone. The method further includes moving the mold shell from the heating zone into the cooling zone. The alloy transfers from the liquid state to a solid state within the mold shell while moving the mold shell from the heating zone to the cooling zone. The method further includes contacting the mold shell with a heat transfer member.

20 Claims, 8 Drawing Sheets

HEAT EXTRACTION OR RETENTION DURING DIRECTIONAL SOLIDIFICATION OF A CASTING COMPONENT

RELATED APPLICATIONS

This application is a continuation application of U.S. Non-Provisional patent application Ser. No. 17/939,317 having a filing date of Sep. 7, 2022, now U.S. Pat. No. 11,833,581, the disclosure of which is incorporated by reference herein in its entirety.

FIELD

The present invention generally relates to materials and processes for producing directionally-solidified castings, and particularly to reducing defects in alloys cast as single-crystal (SX) and directionally-solidified (DS) articles suitable for use as components of gas turbines and other high temperature applications.

BACKGROUND

Components of gas turbines, such as blades, vanes and combustor components, are typically formed of nickel, cobalt or iron-base superalloys characterized by desirable mechanical properties at turbine operating temperatures. Because the efficiency of a gas turbine is dependent on its operating temperatures, there is a demand for components, and particularly turbine buckets, nozzles, combustor components, and other hot gas path components, that are capable of withstanding higher temperatures. As the material requirements for gas turbine components have increased, various processing methods and alloying constituents have been used to enhance the mechanical, physical and environmental properties of components formed from superalloys. For example, buckets, nozzles and other components employed in demanding applications are often cast by directional casting techniques to have DS or SX microstructures, characterized by a crystal orientation or growth direction in a selected direction to produce columnar polycrystalline or single-crystal articles.

Directional casting techniques for producing SX and DS castings generally entail pouring a melt of the desired alloy into an investment mold held at a temperature above the liquidus temperature of the alloy. Solidification of the molten alloy within the mold occurs by gradually withdrawing the mold from a heated zone and into a cooling zone, where cooling occurs by convection and/or radiation. Solidification initiates at the base of the mold and the solidification front progresses to the top of the mold. A high thermal gradient is required at the solidification front to prevent nucleation of new grains during directional solidification processes.

Grain defects can occur during the directional solidification process of geometrically complex components because of local hot spots that do not cool at the same rate as the remainder of the component.

To prevent grain defects during DS casting, various methods to increase thermal gradient and cooling rate are reported in the prior art, including higher mold heating temperature, higher superheat in melting, gas cooling, liquid metal cooling, tight baffle control, alloy modification, graphite embedded at the shell exterior surface for high local thermal conductivity. The embedded graphite was exposed to radiation heat and thus had small effect on heat extraction. It was a static piece attached to the shell throughout the casting process. The heat extraction could not be temporally controlled with respect to the moment of solidification at the particular location of the casting part. As the next-generation heavy-duty industrial gas turbines (IGT) become larger size, the turbine blades also become significantly taller with more complex shape than the smaller IGT blades and Aviation jet engine blades. The larger casting size causes lower thermal gradient induced by massive latent heat of fusion, and thus it is more challenging to prevent grain defects and maintain high yield.

As such, an improved system and method for cooling a casting component during the directional solidification process is desired and would be appreciated in the art.

BRIEF DESCRIPTION

Aspects and advantages of the casting systems and methods in accordance with the present disclosure will be set forth in part in the following description, or may be obvious from the description, or may be learned through practice of the technology.

In accordance with one embodiment, a method of forming a directionally-solidified casting component using a casting system is provided. The casting system includes a chamber having a heating zone and a cooling zone separated by a baffle plate. The method includes pouring an alloy in a liquid state into a mold shell. The mold shell is positioned on a chill plate within the heating zone. The method further includes moving the mold shell from the heating zone into the cooling zone. The alloy transfers from the liquid state to a solid state within the mold shell while moving the mold shell from the heating zone to the cooling zone. The method further includes contacting the mold shell with a heat transfer member.

In accordance with another embodiment, a casting system for forming a directionally-solidified casting component is provided. The casting system includes a chamber and a baffle plate disposed within the chamber. The chamber and the baffle plate collectively defining a heating zone and a cooling zone. The heating zone and the cooling zone separated by the baffle plate. The casting system further includes a chill plate that is movable between the heating zone and the cooling zone. The casting system further includes a mold shell disposed on the chill plate. The casting system further includes a heat transfer member extending from a first end to a second end. The heat transfer member is actuatable between a first position in which the second end is not in contact with the mold shell and a second position in which the second end is in contact with the mold shell.

These and other features, aspects and advantages of the present casting systems and methods will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present casting systems and methods, including the best mode of making and using the present systems and methods, directed to one of ordinary skill in the art, is set forth in the specification, which makes reference to the appended figures, in which.

DETAILED DESCRIPTION

Figure 1:
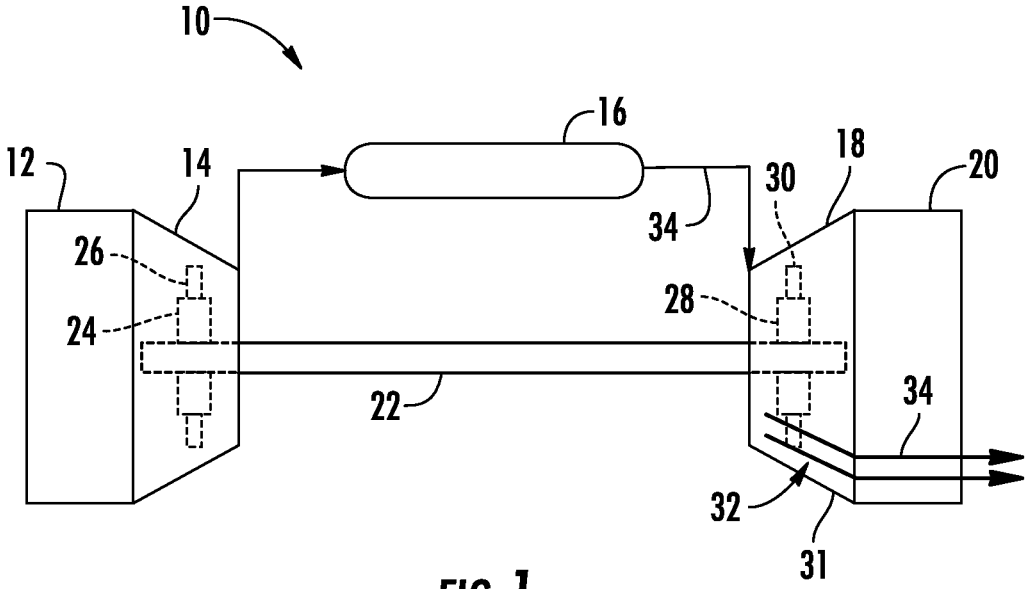
FIG. 1 is a schematic illustration of a turbomachine in accordance with embodiments of the present disclosure.

Reference now will be made in detail to embodiments of the present casting systems and methods, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

The term "fluid" may be a gas or a liquid. The term "fluid communication" means that a fluid is capable of making the connection between the areas specified.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. However, the terms "upstream" and "downstream" as used herein may also refer to a flow of electricity. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

Terms of approximation, such as "about," "approximately," "generally," and "substantially," are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or is satisfied by any one of the following: A is true (or present) and B is false (or not present), A is false (or not present) and B is true (or present), and both A and B are true (or present).

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Referring now to the drawings, FIG. 1 illustrates a schematic diagram of one embodiment of a turbomachine, which in the illustrated embodiment is a gas turbine 10. Although an industrial or land-based gas turbine is shown and described herein, the present disclosure is not limited to a land-based and/or industrial gas turbine unless otherwise specified in the claims. For example, the invention as described herein may be used in any type of turbomachine including but not limited to a steam turbine, an aircraft gas turbine, or a marine gas turbine.

As shown, gas turbine 10 generally includes an inlet section 12, a compressor section 14 disposed downstream of the inlet section 12, a plurality of combustors (not shown) within a combustor section 16 disposed downstream of the compressor section 14, a turbine section 18 disposed downstream of the combustor section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a portion of the shaft 22 that extends through the turbine section 18. The turbine section 18 further includes an outer casing 31 that circumferentially surrounds the portion of the shaft 22 and the rotor blades 30, thereby at least partially defining a hot gas path 32 through the turbine section 18.

During operation, a working fluid such as air flows through the inlet section 12 and into the compressor section 14 where the air is progressively compressed, thus providing pressurized air to the combustors of the combustor section 16. The pressurized air is mixed with fuel and burned within each combustor to produce combustion gases 34. The combustion gases 34 flow through the hot gas path 32 from the combustor section 16 into the turbine section 18, wherein energy (kinetic and/or thermal) is transferred from the combustion gases 34 to the rotor blades 30, causing the shaft 22 to rotate. The mechanical rotational energy may then be used to power the compressor section 14 and/or to generate electricity. The combustion gases 34 exiting the turbine section 18 may then be exhausted from the gas turbine 10 via the exhaust section 20.

Referring now to FIGS. 2 through 8, a cross-sectional view of a casting system 100 for forming a directionally-solidified casting component is illustrated in accordance with embodiments of the present disclosure. As will be explained below in more detail, the directionally-solidified casting component may be formed from molten alloy that solidifies in a mold shell 122. In exemplary implementations, the directionally-solidified casting component may be a turbomachine component (such as a rotor blade, stator vane, fuel nozzle, etc.). For example, the directionally-solidified casting component may be a rotor blade, such that the casting component includes a shank and an airfoil extending from the shank. In this way, the mold shell 122 may a shank portion 102 and an airfoil portion 104 corresponding with the shape of the shank and airfoil of the turbomachine rotor blade. The casting system 100 may define a cartesian coordinate system having a vertical direction V, a longitudinal direction L, and a transverse direction T (not shown, but extending into and out of the page in FIG. 2). The vertical direction V, the longitudinal direction L, and the transverse direction T may be mutually perpendicular to one another.

As shown, the casting system 100 includes a chamber 108 and a baffle plate 110 disposed within the chamber 108. For example, the chamber 108 may be a solid structure that defines an internal volume 112 (i.e., as used herein, the term "chamber" refers to the solid walls that define an internal volume). The baffle plate 110 may separate the internal volume 112 into a heating zone 114 and a cooling zone 116. For example, the chamber 108 and the baffle plate 110 may collectively define the heating zone 114 and a cooling zone 116. The heating zone 114 and the cooling zone 116 may be separated by the baffle plate 110, such that a first side of the baffle plate 110 defines the heating zone 114 and a second side of the baffle plate 110 defines the cooling zone 116.

The casting system 100 may further include a chill plate 118 that is movable (e.g., vertically movable) between the heating zone 114 and the cooling zone 116. For example, the chill plate 118 may be coupled to a shaft 120, and the shaft 120 may be actuatable along the vertical direction V (e.g., via one or more linear actuators 201, which are represented by the circled "A"). In various embodiments (not shown), the chill plate 118 may be a water-cooled chill plate 118. For example, the chill plate 118 may have one or more water cooling circuits defined therein, which circulate water through the chill plate 118. Additionally, in many embodiments, the chill plate 118 may be composed of a highly thermally conductive material, such as copper or a copper alloy.

The casting system 100 may further include a mold shell 122 disposed on the chill plate 118. For example, the mold shell 122 may extend vertically from a base 125 disposed on the chill plate 118 to a tip 126. The mold shell 122 may define a cavity 128 into which an alloy 162 in a liquid state (i.e., liquid state alloy 164) may be poured in the heating zone 114 (e.g., from the crucible 124). Subsequently, the mold shell 122 may be moved (e.g., by actuating the shaft 120 to move the chill plate 118 and the mold shell 122 from the heating zone 114 into the cooling zone 116). As the mold shell 122 is moved into the cooling zone 116, the alloy may solidify to a solid state (i.e., solid state alloy 166) within the mold shell 122 in the vertical direction V (i.e., directionally solidify) from the base 125 to the tip 126 of the mold shell 122, thereby forming the directionally-solidified casting component. For example, the alloy 162 may transfer from a liquid state to a solid state as the mold shell 122 is moved from the heating zone 114 and the cooling zone 116. As illustrated in FIGS. 2 through 8, the horizontal dashed lines within the mold shell 122 may represent the alloy 162 in the liquid state (e.g., the liquid state alloy 164), and the cross hatching within the mold shell 122 may represent the alloy 162 in the solid state (e.g., the solid state alloy 166).

A solidification front 130 may form within the mold shell 122 between the alloy 162 in the liquid state (164) and the alloy 162 in the solid state (166) while the mold shell 122 is moved from the heating zone 114 to the cooling zone 116. While the solidification front 130 is illustrated as a line, it should be appreciated that the solidification front 130 may be a range (e.g., a vertical range) within the mold shell 122. More particularly, the solidification front 130 may portions of the alloy 162 that are within solidification temperature range. The solidification temperature range may be the range of temperatures where the alloy 162 may transfer from the liquid state to the solid state. Additionally, the alloy 162 at the solidification front 130 (and above) may be above the solidus temperature for the alloy 162. That is, the solidus temperature is the highest temperature at which the alloy 162 is completely solid, and the temperature at the solidification line (and above with respect to the vertical direction V) may be greater than the solidus temperature.

In many embodiments, the chamber 108 may be a vacuum chamber which may be evacuated by a vacuum system 132. An electric heating element 134 may be disposed in the heating zone 114 to keep the alloy 162 within the mold shell 122 above the solidus temperature while in the heating zone 114 (e.g., maintain liquid state alloy 164). For example, the electric heating element 134 may surround the mold shell 122 when it is positioned within the heating zone 114. The baffle plate 110 may define an opening 111 the mold shell 122 move between the heating zone 114 and the cooling zone 116. In various embodiments, the baffle plate 110 is positioned on top of the chill plate 118. The opening 111 may have a diameter that is about the size of the largest top-down projected area of the mold shell 122.

To produce a directionally solidified casting component, the mold shell 122 is inserted into the heating zone 114 by moving the shaft 120 vertically upward. The liquid state alloy 164 is poured into the mold shell 122 by the crucible 124, and the shaft is then moved vertically downward, such that the mold shell 122 passes through the opening 111 from the heating zone 114 to the cooling zone 116. As a result, the alloy 162 transfers from a liquid state to a solid state in the vertical direction V. For example, the alloy 162 first solidifies at the base 125 of the mold shell 122, and the solidification front moves upward vertically to the tip 126 of the mold shell 122.

Due to the geometric complexity of the directionally-solidified casting component, various portions of the alloy 162 within the mold shell 122 may not solidify at the same rate (e.g., some portions may solidify faster/slower than others), which may result in one or more component defects. As such, the exemplary casting system 100 described herein includes a heat transfer member 140 for increasing or decreasing the magnitude and direction of thermal gradient as well as solidification rate of the alloy at the various portions to prevent defects from forming. The heat transfer member 140 may be movable within the chamber 108 via an actuator(s) 201. In some embodiments, the heat transfer member 140 extend through a hole in the baffle plate 110 (e.g., a separate hole than the opening 111).

As shown in FIGS. 2 through 8, the casting system 100 may further include a controller 200, which is illustrated as a block diagram to show the suitable components that may be included within the controller 200. As shown, the controller 200 may include one or more processor(s) 202 and associated memory device(s) 204 configured to perform a variety of computer-implemented functions (e.g., performing the methods, steps, calculations and the like and storing relevant data as disclosed herein). Additionally, the controller 200 may also include a communications module 206 to facilitate communications between the controller 200 and the various components of the system 100, such as the crucible 124, the shaft 120, the vacuum system 132, the electric heating element 134, and/or the actuator(s) 201. For example, the communications module 218 may be in communication with the actuator(s) 201, in order to allow the processor 202 to selectively move the heat transfer member 140. It should be appreciated that the crucible 124, the shaft 120, the vacuum system 132, the electric heating element 134, and actuator(s) 201 may be communicatively coupled to the communications module 206 using any suitable means (e.g., a wired connection or a wireless connection using any suitable wireless communications protocol known in the art).

As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 204 may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 204 may generally be configured to store suitable computer-readable instructions that, when implemented by the processor(s) 202, configure the system 100 to perform various functions and/or operations including, but not limited to, pouring, with the crucible 124, an alloy 162 in a liquid state into the mold shell 122; moving, with the shaft 120, the mold shell 122 from the heating zone 114 into the cooling zone 116; and contacting, with the heat transfer member 140, the mold shell 122.

The heat transfer member 140 may extend from a first end 142 to a second end 144. The heat transfer member 140 may be movable in any of the vertical direction V, the longitudinal direction L, and/or the transverse direction T. For example, the heat transfer member 140 may be coupled to an actuator(s) 201, and the actuator(s) 201 may be operatively coupled to a controller 200, such that the controller 200 can adjust a position of the heat transfer member 140 by operating the actuator(s) 201. Additionally, the heat transfer member 140 may be extendable, such that the length of the heat transfer member 140 may be increased/decreased. For example, the heat transfer member 140 may have a telescopic construction that is extendable by the actuator(s) 201. The actuator(s) 201 may include linear actuators and/or rotary actuators, such that the heat transfer member 140 may be movable/rotatable in any of the vertical direction V, the longitudinal direction L, and the transverse direction T.

Figure 2:
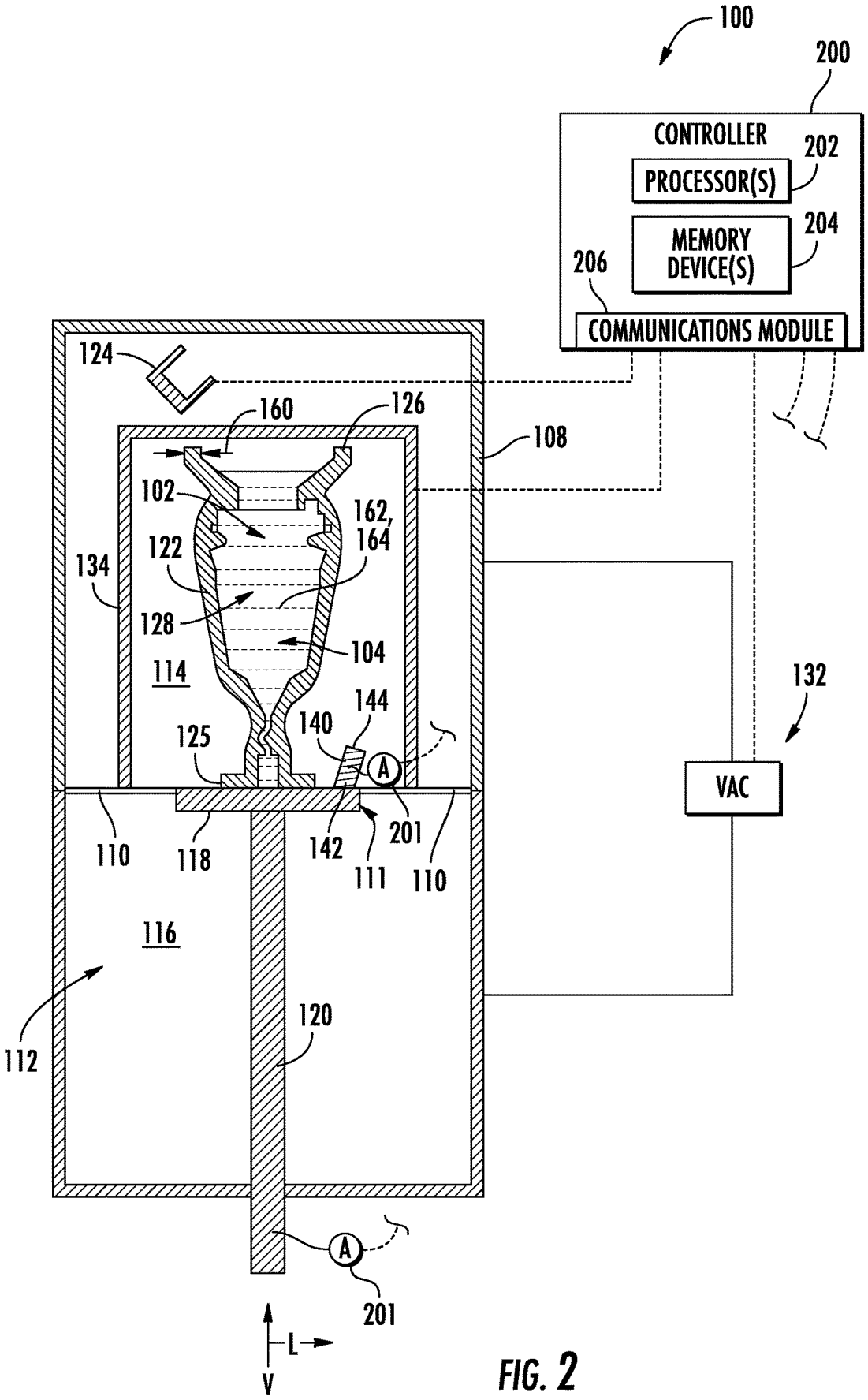
FIG. 2 illustrates a cross-sectional view of a casting system for forming a directionally-solidified casting component in accordance with embodiments of the present disclosure.
Figures 3, 4:
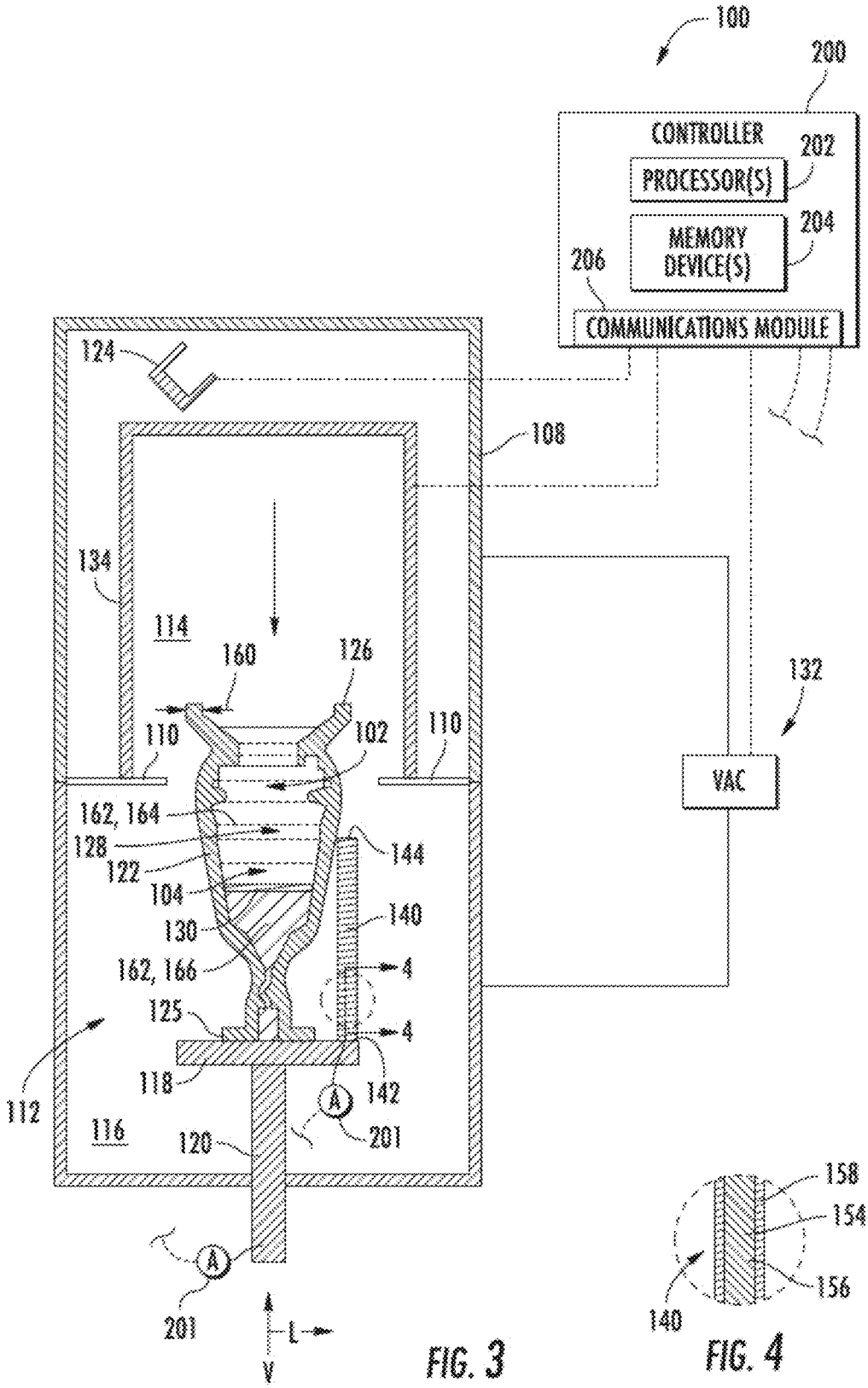
FIG. 3 illustrates a cross-sectional view of a casting system for forming a directionally-solidified casting component in accordance with embodiments of the present disclosure.
FIG. 4 illustrates a cross-sectional view of a casting system for forming a directionally-solidified casting component in accordance with embodiments of the present disclosure.

As shown in FIG. 2 and FIG. 3 collectively, the heat transfer member 140 may be actuatable between a first position (FIG. 2) in which the second end 144 is not in contact with the mold shell 122 and a second position (FIG. 3) in which the second end is in contact with the mold shell 122. As should be appreciated, while FIG. 3 illustrates the heat transfer member 140 in contact with one particular portion of the mold shell 122, the heat transfer member 140 may be actuated to contact any portion of the mold shell 122 (e.g., the exterior surface of the mold shell 122).

In many embodiments, the first end 142 of the heat transfer member 140 may be coupled to the chill plate 118. For example, the first end 142 of the heat transfer member 140 may be pivotably coupled to the chill plate 118, such that the first end 142 may rotate relative to the chill plate 118. Coupling the first end 142 of the heat transfer member 140 to the chill plate 118 may advantageously increase the efficiency of the heat transfer member 140 by increasing the thermal gradient between the heat transfer member 140 and the mold shell 122. For example, the chill plate 118 may cool the heat transfer member 140, thereby widening the difference in temperature between the heat transfer member 140 and the mold shell 122, which may allow the heat transfer member to increase the solidification rate of the alloy 162 within the mold shell 122 proximate the location where the heat transfer member 140 contacts the mold shell 122.

Alternatively, or additionally, the first end 142 of the heat transfer member 140 may be coupled to the chamber 108. For example, the first end 142 of the heat transfer member 140 may be pivotably coupled to the chamber 108, such that the first end 142 may rotate relative to the chamber 108. Particularly, the first end 142 of the heat transfer member 140 may be coupled to the chamber 108 in either the heating zone 114 or the cooling zone 116. Coupling the first end 142 of the heat transfer member 140 to the chamber 108 in the heating zone 114 may advantageously increase the efficiency of the heat transfer member 140 by decreasing the thermal gradient between the heat transfer member 140 and the mold shell 122. For example, the heating zone 114 may heat the heat transfer member 140, thereby decreasing the difference in temperature between the heat transfer member 140 and the mold shell 122, which may allow the heat transfer member to decrease the solidification rate of the alloy 162 within the mold shell 122 proximate the location where the heat transfer member 140 contacts the mold shell 122. Additionally, heat retention uses of the heat transfer member 140, the heat transfer member 140 may thermally couple to the shell mold 122 via radiation, such that the heat transfer member 140 may decrease the thermal gradient between the heat transfer member 140 and the mold shell 122 without contacting the mold sell 122.

By contrast, coupling the first end 142 of the heat transfer member 140 to the chamber 108 in the cooling zone 116 may advantageously increase the efficiency of the heat transfer member 140 by increasing the thermal gradient between the heat transfer member 140 and the mold shell 122. For example, the cooling zone 116 may cool the heat transfer member 140, thereby increasing the difference in temperature between the heat transfer member 140 and the mold shell 122, which may allow the heat transfer member to increase the solidification rate of the alloy 162 within the mold shell 122 proximate the location where the heat transfer member 140 contacts the mold shell 122. In this way, depending at least partially on the location to which the first end 142 of heat transfer member 140 is attached, the function of the heat transfer member 140 may vary from increasing the solidification rate of the alloy 162 to decreasing the solidification rate of the alloy 162 by contacting the mold shell 122.

FIG. 4 illustrates an enlarged cross-sectional view of the heat transfer member 140 in accordance with embodiments of the present disclosure. Particularly, FIG. 4 illustrates an enlarged cross-sectional view of the detail outlined by a dashed line in FIG. 3. As shown, the heat transfer member 140 may include a main body 154 that defines an outer surface 156. Additionally, in many embodiments, the heat transfer member 140 may include an oxidation resistant coating 158. The oxidation resistant coating 158 may be any suitable oxidation resistant coating that is capable of use at high temperatures. As shown in FIG. 4, the oxidation resistant coating may be disposed on the outer surface 156 of the main body 154. Alternatively, the heat transfer member 140 may be uncoated, such that the outer surface 156 is the exterior surface of the heat transfer member 140.

In many embodiments, the mold shell may define a shell thickness 160 of between about 2 mm and about 25 mm, or such as between about 3 mm and about 23 mm, or such as between about 4 mm and about 22 mm, or such as about 5 mm and about 21 mm, or such as between about 6 mm and about 20 mm This shell thickness may be smaller than previous designs, which advantageously promotes heat transfer between the alloy 162 and the heat transfer member 140 when the heat transfer member 140 is in contact with the mold shell 122. For example, the small shell thickness 160 advantageously increases the thermal conductivity between the alloy 162 and the heat transfer member 140, such that more heat is removed from the alloy 162 by the heat transfer member 140 during contact with the mold shell 122.

FIGS. 5 through 8 each illustrate a cross-sectional view of an exemplary casting system 100 in accordance with embodiments of the present disclosure. Particularly, FIGS. 5 through 8 each illustrate the casting system 100 in a different position. As shown, the system 100 may include a plurality of heat transfer members 140 each extending from a respective first end 142 coupled to the system 100 to a respective second end 144. Each of the heat transfer members 140 may be operatively coupled to the controller 200 and may be independently actuatable relative to one another. In such embodiments, multiple heat transfer members 140 may extend from the chill plate 118, one or more heat transfer members 140 may extend from the casing (e.g., in either the heating zone 114 or the cooling zone 116), and one or more heat transfer members 140 may extend from the baffle plate 110 (not shown).

Figure 5:
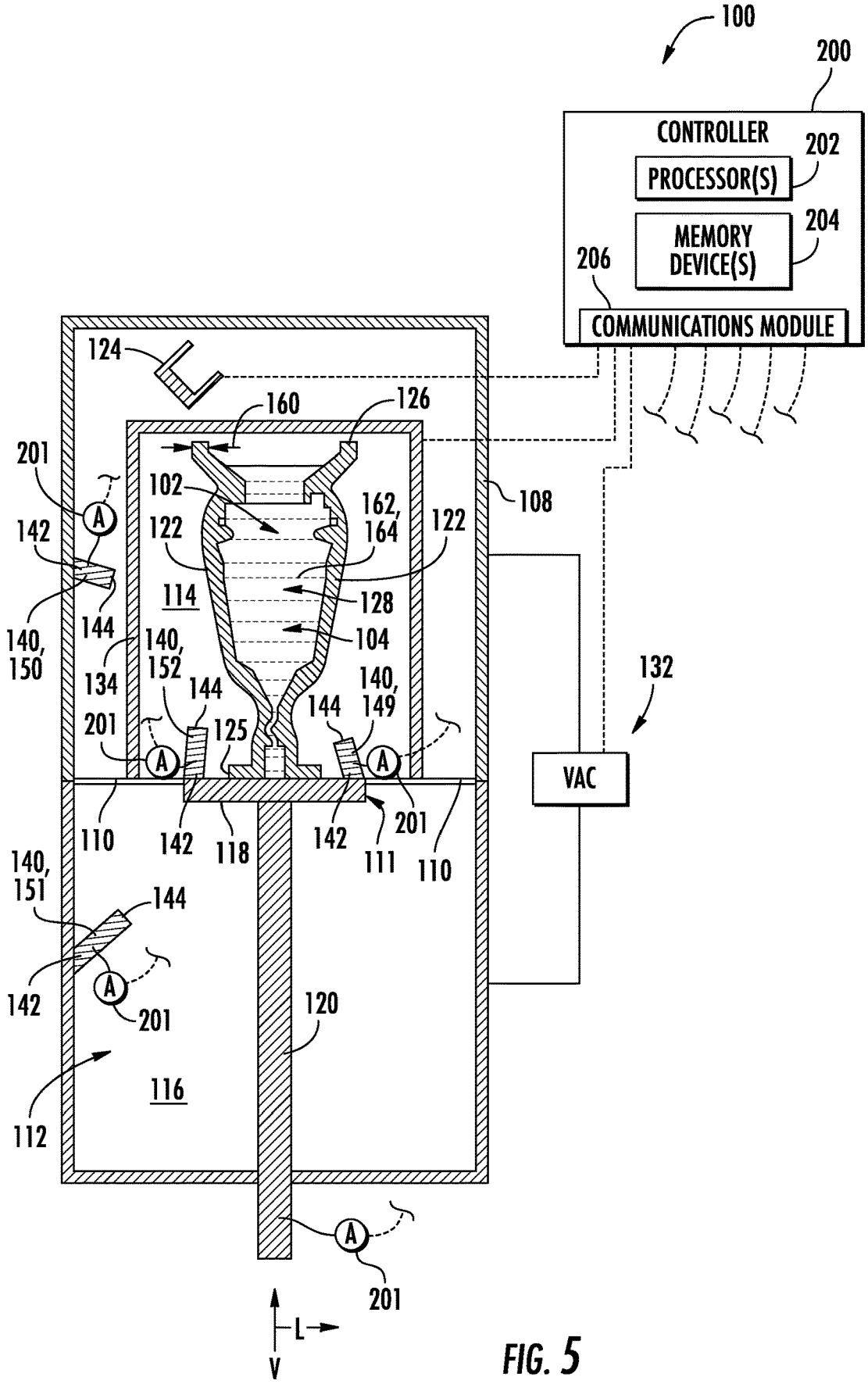
FIG. 5 illustrates a cross-sectional view of a casting system for forming a directionally-solidified casting component in accordance with embodiments of the present disclosure.
Figure 6:
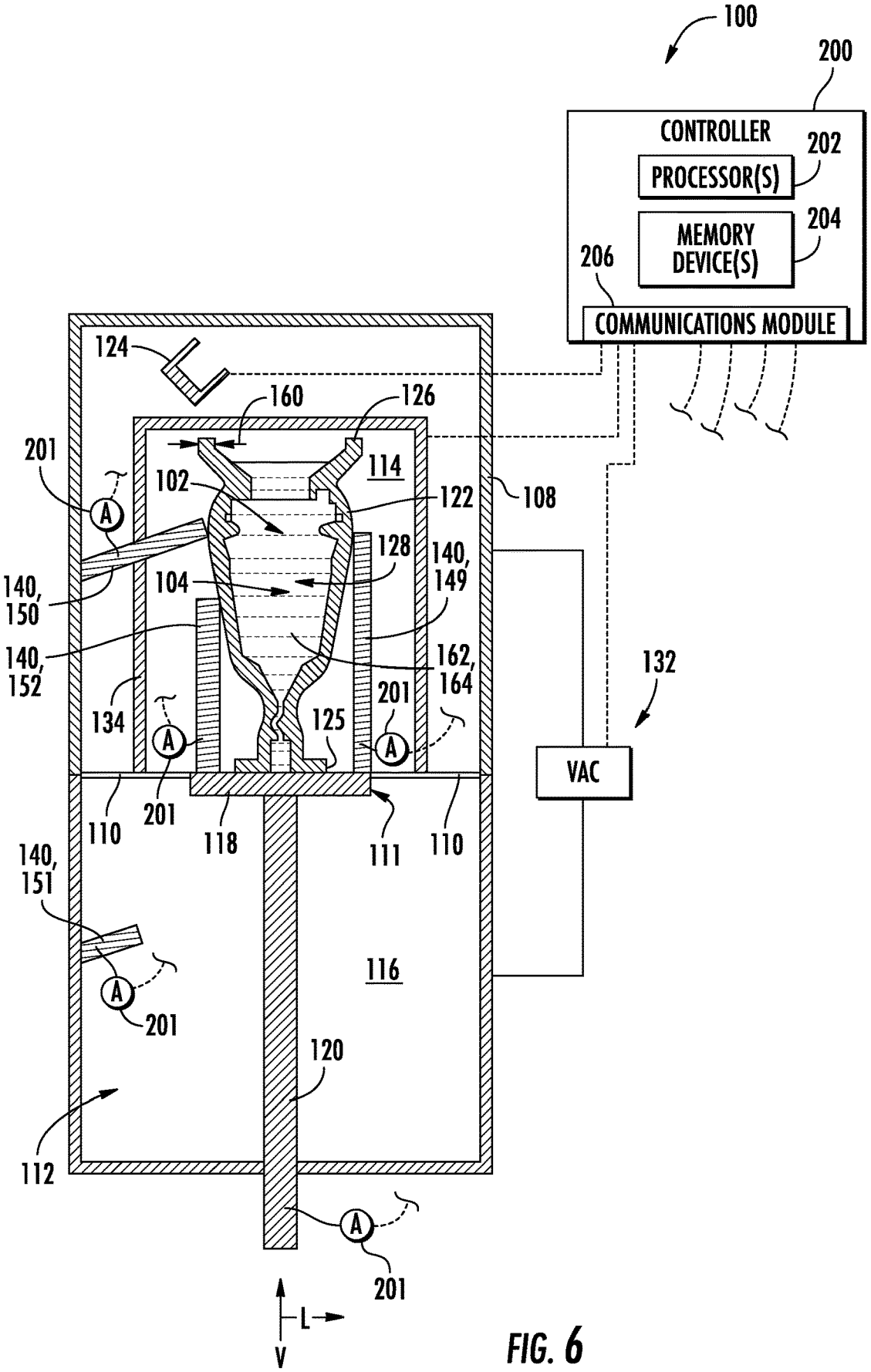
FIG. 6 illustrates a cross-sectional view of a casting system for forming a directionally-solidified casting component in accordance with embodiments of the present disclosure.
Figure 7:
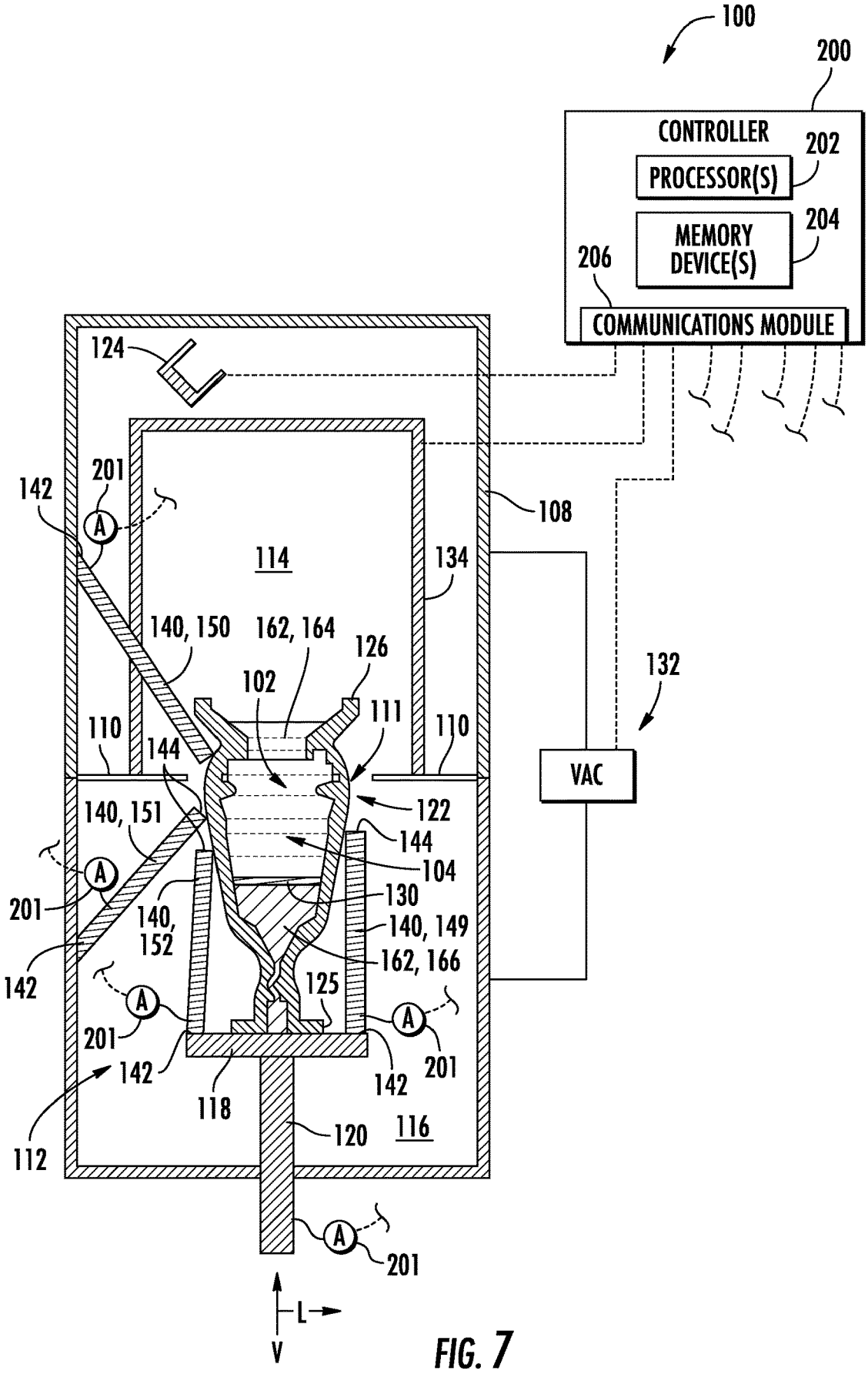
FIG. 7 illustrates a cross-sectional view of a casting system for forming a directionally-solidified casting component in accordance with embodiments of the present disclosure.
Figure 8:
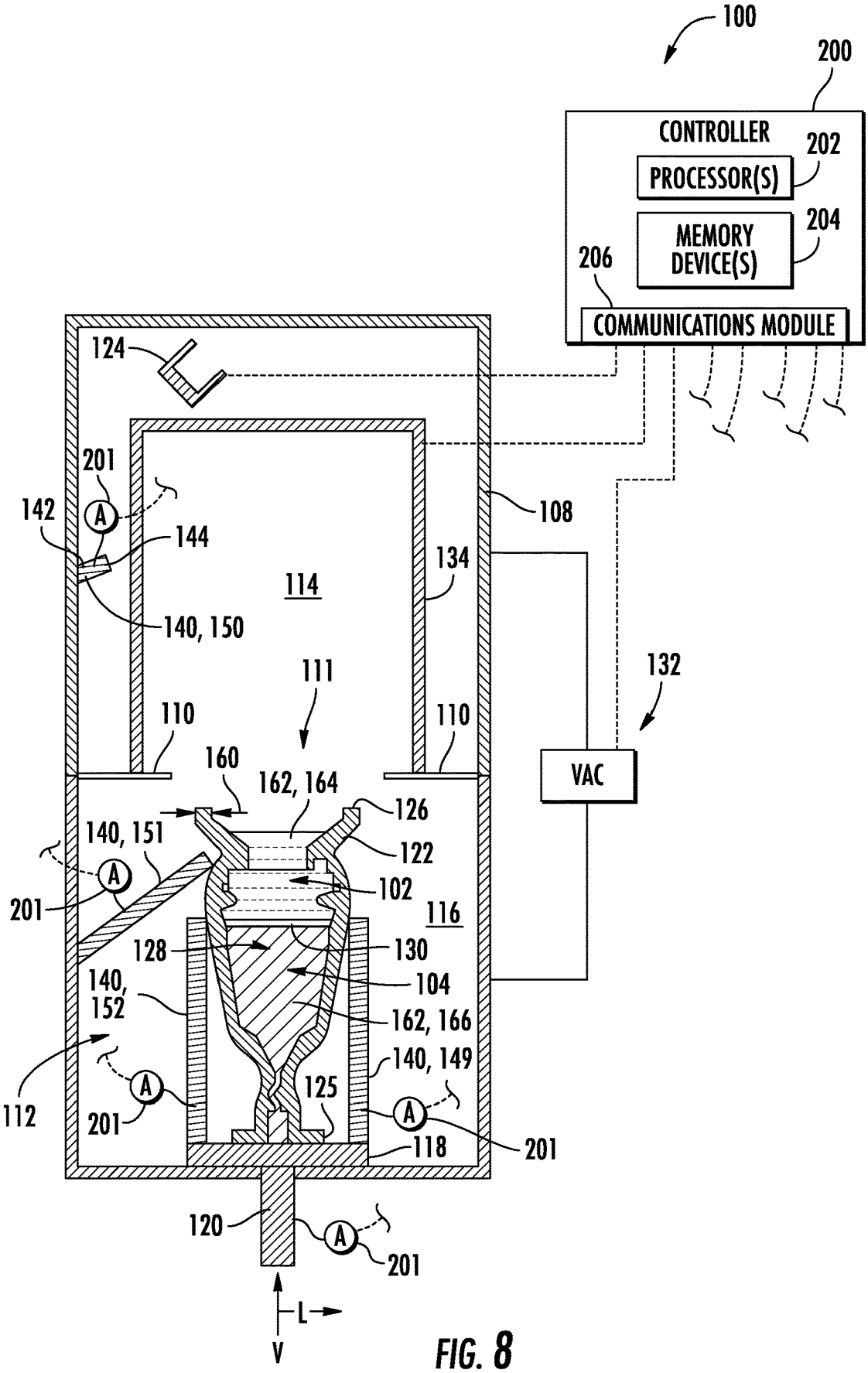
FIG. 8 illustrates a cross-sectional view of a casting system for forming a directionally-solidified casting component in accordance with embodiments of the present disclosure.

As shown, FIG. 5 illustrates the casing system immediately following the pouring stage. That is, the alloy 162 in a liquid state has been poured from the crucible 124 into the mold shell 122. As shown in FIG. 5, after (and/or during) the pouring of the alloy 162 into the mold shell 122, each of the heat transfer members 140 may be out of contact with the mold shell 122 (i.e., in a retracted position). Alternatively, as shown in FIG. 6, one or more of the heat transfer members 140 may be in contact with the mold shell 122 after (and/or during) the pouring of the alloy 162 into the mold shell 122. That is, one or more of the heat transfer members 140 may be in contact with the mold shell 122 (at separate locations) when the mold shell 122 is entirely within the cooling zone 116. FIG. 7 illustrates the casing system 100 in a withdrawing stage, where the shaft 120 is being moved vertically to reposition (or translate) the mold shell 122 from the heating zone 114 to the cooling zone 116 in order to solidify the alloy 162. As shown, the plurality of heat transfer members 140 may each contact separate locations of the mold shell 122 while the mold shell 122 is translating from the heating zone 114 to the cooling zone 116. Particularly, one or more heat transfer members 140 may contact the mold shell 122 (e.g., a top portion of the mold shell 122) in the heating zone 114, and simultaneously, one or more heat transfer members 140 may contact the mold shell 122 (e.g., a bottom portion of the mold shell 122) in the cooling zone 116. FIG. 8 illustrates the casing system 100 in a fully withdrawn stage, in which the shaft 120 has fully removed the mold shell 122 from the heating zone 114 into the cooling zone 116 (e.g., by vertically translating the shaft 120, thereby moving the mold shell through the opening 111 in the baffle plate 110 from the heating zone 114 into the cooling zone 116). As shown in FIG. 8, one or more of the heat transfer members 140 may contact the mold shell 122 (at separate locations) when the mold shell 122 is entirely within the cooling zone 116.

Particularly, the system 100 may include a first heat transfer member 149, a second heat transfer member 150, a third heat transfer member 151, and a fourth heat transfer member 152. Each of the heat transfer members 149, 150, 151, 152 may be independently actuatable relative to one another, such that the heat transfer members 149, 150, 151, 152 may each extend, retract, and/or rotate to contact the mold shell 122 within the chamber 108. Each of the heat transfer members 149, 150, 151, 152 may extend from a different location within the chamber 108. For example, the first heat transfer member 149 and the fourth heat transfer member 152 may extend from the chill plate 118 (e.g., from opposite sides of the chill plate 118). The second heat transfer member 150 and the third heat transfer member 151 may extend from the chamber 108 (such as from chamber 108 in the heating zone 114 or in the cooling zone 116).

Alternatively, one or more of the heat transfer members 140 may extend from the baffle plate 110 (not shown).

While FIGS. 5 through 8 illustrate a casing system 100 having four heat transfer members 140, it should be appreciated that the casing system 100 may include any number of heat transfer members 140, and the present disclosure should not be limited to any particular number of heat transfer members 140 unless specifically recited in the claims.

The material from which the heat transfer member 140 is formed may impact the heat transfer properties of the heat transfer member 140. For example, in some embodiments, the heat transfer member 140 may be formed from a material having a high thermal conductivity such that the contact between the heat transfer member 140 and the mold shell 122 increases a solidification rate (or thermal gradient) of the alloy 162 (e.g., proximate the contact location). For example, the heat transfer member 140 may have a higher thermal conductivity than the alloy 162. Particularly, the heat transfer member 140 may be formed from (or composed of) one or more of molybdenum alloy, graphite, silicon carbide, and/or a ceramic matrix composite silicon carbide, high-melting point refractory alloy.

Alternatively, or additionally, the heat transfer member 140 may be formed from a material having a low thermal conductivity such that the contact between the heat transfer member 140 and the mold shell decreases a solidification rate (or thermal gradient) of the alloy 162 (e.g., proximate the contact location). For example, the heat transfer member 140 may have a lower thermal conductivity than the alloy 162. Particularly, the heat transfer member 140 may be formed from (or composed of) of one or more of silica, alumina, zircon, zirconia, or yttria. Additionally, for heat retention, contact between the heat transfer member 140 and the mold shell 122 may not be required. For example, in some implementations, the heat transfer member 140 may thermally couple to the shell mold 122 via radiation, such that the heat transfer member 140 transfers heat to the shell mold 122 via radiation. In such implementations, the magnitude of the radiation may be controlled by altering the distance between the heat transfer member 140 and the shell mold 122 (e.g., moving the heat transfer rod 140 closer to the shell mold 122 may increase the radiation, and moving the heat transfer rod 140 further away from the shell mold may decrease the radiation).

In many embodiments, the first heat transfer member 149 may be composed of a first material, and the second heat transfer member 150 may be formed from a second material, the third heat transfer member 151 may be formed of a third material, and the fourth heat transfer member 152 may be formed of a fourth material. The first, second, third, and fourth materials may be the same, different, or any combination. For example, the first material may be formed from a material having a high thermal conductivity (such as molybdenum alloy, graphite, silicon carbide, and/or a ceramic matrix composite silicon carbide), and the second material may be formed from a material having a low thermal conductivity (such as silica, alumina, zircon, zirconia, yttria, or chromia).

Figure 9:
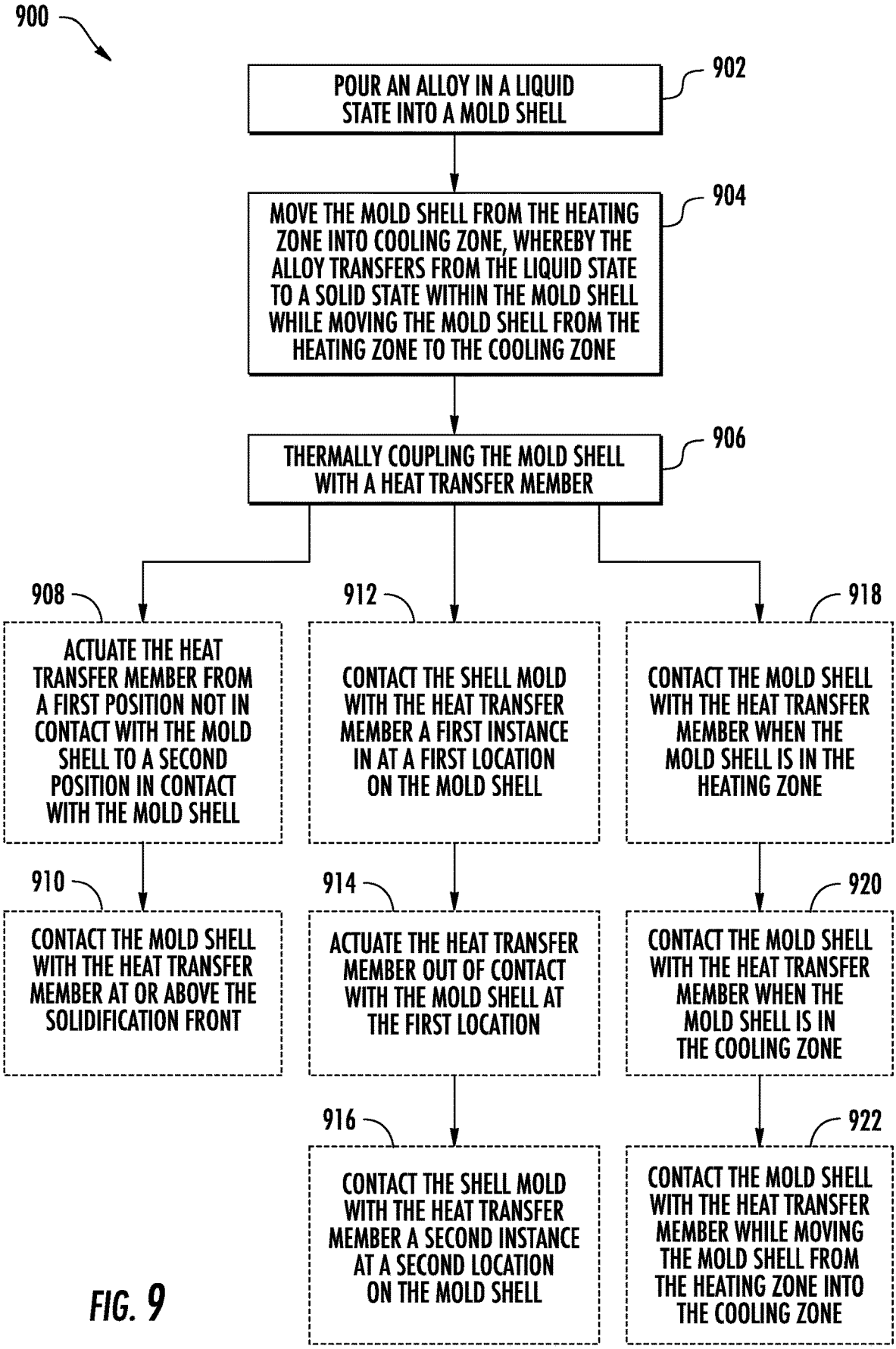
FIG. 9 is a flow diagram of one embodiment of a method of forming a directionally-solidified casting component using a casting system in accordance with embodiments of the present disclosure.

Referring now to FIG. 9, a flow diagram of one embodiment of a method 900 of forming a directionally-solidified casting component using a casting system 100 is illustrated in accordance with aspects of the present subject matter. In general, the method 900 will be described herein with reference to the casting system 100 and the gas turbine 10 described above with reference to FIGS. 1 through 8. However, it will be appreciated by those of ordinary skill in the art that the disclosed method 900 may generally be utilized in connection with any casting system having any other suitable system configuration. In addition, although FIG. 9 depicts steps performed in a particular order for purposes of illustration and discussion, the methods discussed herein are not limited to any particular order or arrangement unless otherwise specified in the claims. One skilled in the art, using the disclosures provided herein, will appreciate that various steps of the methods disclosed herein can be omitted, rearranged, combined, and/or adapted in various ways without deviating from the scope of the present disclosure.

As shown in FIG. 9, the method 900 may include at (902) pouring an alloy 162 in a liquid state into a mold shell 122. The mold shell 122 may be positioned on a chill plate 118 within the heating zone 114. Prior to pouring at (902) the alloy 162 may be heated in the crucible 124 to a molten or liquid state, and once the alloy 162 is in a liquid state, the alloy 162 may be poured by the crucible 124 into the mold shell 122. For example, the alloy 162 may be poured through an opening at the tip 126 of the mold shell 122 into the cavity 128 defined by the mold shell 122, such that the alloy 162 fills the cavity 128 defined by the mold shell 122. Alternatively, in some embodiments (not shown), the cavity 128 of the mold shell 122 may be filled via a down sprue, such that the alloy 162 is poured through the mold shell 122 at a location between the base 125 and the tip 126. The cavity 128 may correspond in shape with the directionally solidified casting component, such that the cavity 128 may have a rotor blade shape having a shank portion 102 and an airfoil portion 104.

In many implementations, prior to the pouring step, the method 900 may further include evacuating the chamber 108 with a vacuum system 132. The vacuum system 132 may remove all the air from the chamber 108, thereby creating a vacuum. Additionally, in some implementations, when the mold shell 122 is within the heating zone 114 (e.g., during the pouring step and/or after the pouring step), an electric heating element 134 may heat the alloy 162 within the mold shell 122 to keep or maintain the alloy 162 in the liquid state.

In exemplary implementations, the method 900 may further include at (904) moving the mold shell 122 from the heating zone 114 into the cooling zone 116. As a result, the alloy 162 transfers from the liquid state to a solid state within the mold shell 122 while moving the mold shell 122 from the heating zone 114 to the cooling zone 116. Moving at (904) may include actuating the shaft 120 (e.g., by sending a signal with the controller 200) to translate the shaft 120 in the vertical direction V, thereby moving the mold shell through the opening 111 in the baffle plate 110 from the heating zone 114 into the cooling zone 116.

In many implementations, the method 900 may further include at (906) thermally coupling the mold shell 122 with a heat transfer member 140. For example, the heat transfer member 140 may extend from a first end 142 coupled to the casting system 100 to a second end 144 (or a free end), and the heat transfer member 140 may be movable in any direction within the chamber 108. In this way, the heat transfer member 140 may physically touch and untouch (i.e., selectively contact) the mold shell 122 in various locations while the alloy 162 is solidifying (e.g., while the alloy is above the solidus temperature), thereby altering (i.e., increasing or decreasing) the local solidification rate of the alloy 162 proximate the contact location. This may advantageously minimize grain defects caused by improper solidification of the alloy 162 (i.e., solidification that occurs too quickly or slowly). Additionally, the heat transfer member 140 may allow for the casting system 100 to produce more geometrically complex components without defects.

In many embodiments, as shown in FIG. 9, thermally coupling at (906) may further include an optional step (as indicated by the dashed box) at (908) of actuating the heat transfer member 140 from a first position not in contact with the mold shell 122 to a second position in contact with the mold shell 122. For example, the heat transfer member 140 may be extended and/or retracted, rotated, and/or translated by one or more actuators 201 to move the heat transfer member 140 into and out of contact with the mold shell 122.

Additionally, in many implementations of the method 900, a solidification front 130 may form within the mold shell 122 between the liquid state alloy 164 and the solid state alloy 166 while the mold shell 122 is moved from the heating zone 114 to the cooling zone 116. In such implementations, the method 900 may at (910) contacting the mold shell 122 with the heat transfer member 140 at or above the solidification front 130 with respect to the vertical direction V. In many embodiments, the vertical direction V may be the opposite of the direction of gravity. The contact between the heat transfer member 140 and the mold shell 122 may take place at a vertical location where the alloy 162 has not yet fully solidified (e.g., the alloy 162 may be above the solidus temperature). As such, contact by the heat transfer member 140 on the mold shell 122 at vertical location where the alloy 162 is above the solidus temperature will alter the rate at which the alloy 162 drops in temperature (either decreasing the rate or increasing the rate), thereby favorably influencing the resulting grain structure of the directionally-solidified casting component.

In various implementations, as shown in FIG. 9, thermally coupling at (906) may further include at (912) contacting the mold shell 122 with the heat transfer member 140 a first instance in at a first location on the mold shell 122. Additionally, the method 900 my include at (914) actuating the heat transfer member 140 out of contact with the mold shell 122 at the first location. Further, the method 900 may include at (916) contacting the mold shell 122 with the heat transfer member 140 a second instance at a second location on the mold shell 122. The second location may be different than the first location. Between contacting the mold shell 122 in the first location at the first instance and contacting the mold shell 122 in the second location at the second instance, the mold shell 122 may be moved vertically by actuating the shaft 120. Additionally, in many implementations, the mold shell 122 may be moved vertically while being contacted by the heat transfer member 140 in a particular location, such that the heat transfer member 140 may move along with the mold shell 122 to maintain contact.

In many implementations, the thermally coupling at (906) may further include at (918) contacting the mold shell 122 with the heat transfer member 140 when the mold shell 122 is in the heating zone 114 (e.g., entirely within the heating zone 114). Additionally, contacting at (906) may further include at (920) contacting the mold shell 122 with the heat transfer member 140 when the mold shell 122 is in the cooling zone 116 (e.g., entirely within the cooling zone 116). Furthermore, contacting at (906) may further include at (922) contacting the mold shell 122 with the heat transfer member 140 while moving the mold shell 122 from the heating zone 114 into the cooling zone 116 (such that the mold shell 122 may be partially disposed in both the heating zone 114 and the cooling zone 116).

In various embodiments, the heat transfer member 140 may be a first heat transfer member 149, and the method 900 may further include contacting a first portion of the mold shell with the first heat transfer 149 rod to increase a first local solidification rate of the alloy 162 proximate the first portion. In such implementations, the method 900 may further include contacting a second portion of the mold shell 122 with the second heat transfer member 150 to decrease a second local solidification rate of the alloy 162 proximate the second portion. The second portion may be different than the first portion.

In implementations in which heat retention of the alloy 162 is desired, contact between the heat transfer member 140 and the shell mold 122 may not be necessary. For example, in such implementations, thermally coupling at (906) may include thermally coupling the heat transfer member 140 and the shell mold 122 without contact via radiation by moving the heat transfer member 140 into a radiation distance away from the shell mold 122. In such implementations, the magnitude of the radiation may be controlled by altering the radiation distance between the heat transfer member 140 and the shell mold 122. For example, moving the heat transfer rod 140 closer to the shell mold 122 may increase the radiation, and moving the heat transfer rod 140 further away from the shell mold may decrease the radiation. In various implementations, the radiation distance may be up to about 0.5 inches, or such as between about 0.1 inches and about 0.5 inches, or such as between about 0.1 inches and about 0.4 inches, or such as between about 0.2 inches and about 0.3 inches.

The casting system 100 described herein advantageously provides a means for conductive and/or radiative heat transfer during the directionally-solidified casting process by utilizing the heat transfer members 140. The heat transfer members 140 may touch and untouch (i.e., selectively contact) to provide localized conductive or radiative heat transfer between the heat transfer member 140 and the alloy 162, thereby favorably influencing (increasing or decreasing) the solidification rate of the alloy 162 to minimize grain defects.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A method of forming a directionally-solidified casting component using a casting system, the casting system comprising a chamber having a heating zone and a cooling zone separated by a baffle plate, the method comprising: pouring an alloy in a liquid state into a mold shell, the mold shell positioned on a chill plate within the heating zone; moving the mold shell from the heating zone into the cooling zone, whereby the alloy transfers from the liquid state to a solid state within the mold shell while moving the mold shell from the heating zone to the cooling zone; and thermally coupling the mold shell with a heat transfer member.

The method as in any of the preceding clauses, wherein thermally coupling the mold shell with the heat transfer member further comprises: contacting the mold shell with the heat transfer member a first instance in at a first location on the mold shell; actuating the heat transfer member out of contact with the mold shell at the first location; and contacting the mold shell with the heat transfer member a second instance at a second location on the mold shell, the second location being different than the first location.

The method as in any of the preceding clauses, wherein thermally coupling the mold shell with the heat transfer member further comprises: actuating the heat transfer member from a first position not in contact with the mold shell to a second position in contact with the mold shell.

The method as in any of the preceding clauses, wherein the heat transfer member is formed from a material having a high thermal conductivity such that the contact between the heat transfer member and the mold shell increases a solidification rate of the alloy.

The method as in any of the preceding clauses, wherein the heat transfer member is formed from a material having a low thermal conductivity such that the contact between the heat transfer member and the mold shell decreases a solidification rate of the alloy.

The method as in any of the preceding clauses, wherein thermally coupling the mold shell with a heat transfer member further comprises: contacting the mold shell with the heat transfer member when the mold shell is in the heating zone.

The method as in any of the preceding clauses, wherein thermally coupling the mold shell with the heat transfer member further comprises: contacting the mold shell with the heat transfer member when the mold shell is in the cooling zone.

The method as in any of the preceding clauses, wherein thermally coupling the mold shell with the heat transfer member further comprises: contacting the mold shell with the heat transfer member while moving the mold shell from the heating zone into the cooling zone.

The method as in any of the preceding clauses, wherein a solidification front forms within the mold shell between the alloy in the liquid state and the alloy in the solid state while the mold shell is moved from the heating zone to the cooling zone.

The method as in any of the preceding clauses, wherein the thermally coupling step further comprises: contacting the mold shell with the heat transfer member at or above the solidification front.

The method as in any of the preceding clauses, wherein the heat transfer member is a first heat transfer member, and wherein the thermally coupling step further comprises: contacting a first portion of the mold shell with the first heat transfer member to increase a first local solidification rate of the alloy proximate the first portion; and contacting a second portion of the mold shell with a second heat transfer member to decrease a second local solidification rate of the alloy proximate the second portion.

The method as in any of the preceding clauses, wherein the thermally coupling step further comprises: thermally coupling the heat transfer member and the shell mold without contact via radiation by moving the heat transfer member into a radiation distance away from the shell mold.

A casting system for forming a directionally-solidified casting component, the casting system comprising: a chamber; a baffle plate disposed within the chamber, the chamber and the baffle plate collectively defining a heating zone and a cooling zone, the heating zone and the cooling zone separated by the baffle plate; a chill plate movable between the heating zone and the cooling zone; a mold shell disposed on the chill plate; and a heat transfer member extending from a first end to a second end, the heat transfer member actuatable between a first position in which the second end is not in contact with the mold shell and a second position in which the second end is in contact with the mold shell.

The casting system as in any of the preceding clauses, wherein the first end is coupled to the chill plate.

The casting system as in any of the preceding clauses, wherein the first end is coupled to chamber.

The casting system as in any of the preceding clauses, wherein the heat transfer member is composed of one or more of molybdenum alloy, high-melting point refractory alloy, graphite, silicon carbide, or a ceramic matrix composite silicon carbide.

The casting system as in any of the preceding clauses, wherein the heat transfer member is composed of one or more of silica, alumina, zircon, zirconia, chromia, or yttria.

The casting system as in any of the preceding clauses, wherein the heat transfer member includes an oxidation resistant coating.

The casting system as in any of the preceding clauses, wherein the mold shell defines a shell thickness of between about 2 mm and about 25 mm.

The casting system as in any of the preceding clauses, wherein the heat transfer member is a first heat transfer member, and wherein the system further comprises a second heat transfer member.

What is claimed is:

1. A casting system for forming a directionally-solidified casting component, the casting system comprising:

a chamber;

a baffle plate disposed within the chamber, the chamber and the baffle plate collectively defining a heating zone and a cooling zone, the heating zone and the cooling zone separated by the baffle plate;

a chill plate movable between the heating zone and the cooling zone;

a mold shell disposed on the chill plate; and a heat transfer member extending from a first end to a second end, the heat transfer member actuatable between a first position in which the second end is not in contact with the mold shell and a second position in which the second end is in contact with the mold shell, wherein the first end of the heat transfer member is coupled to one of the chill plate or the chamber in both the first position and the second position.

2. The casting system as in claim 1, wherein the first end is coupled to the chill plate in both the first position and the second position.

3. The casting system as in claim 1, wherein the first end is coupled to the chamber in both the first position and the second position.

4. The casting system as in claim 1, wherein the heat transfer member is composed of one or more of molybdenum alloy, high-melting point refractory alloy, graphite, silicon carbide, or a ceramic matrix composite silicon carbide.

5. The casting system as in claim 1, wherein the heat transfer member is composed of one or more of silica, alumina, zircon, zirconia, chromia, or yttria.

6. The casting system as in claim 1, wherein the heat transfer member includes an oxidation resistant coating.

7. The casting system as in claim 1, wherein the mold shell defines a shell thickness of between about 2 mm and about 25 mm.

8. The casting system as in claim 1, wherein the heat transfer member is a first heat transfer member, and wherein the system further comprises a second heat transfer member.

9. A casting system for forming a directionally-solidified casting component, the casting system comprising:

a chamber;

a baffle plate disposed within the chamber, the chamber and the baffle plate collectively defining a heating zone and a cooling zone, the heating zone and the cooling zone separated by the baffle plate;

a chill plate movable between the heating zone and the cooling zone;

a mold shell disposed on the chill plate; and a heat transfer member extending from a first end to a second end, the first end being coupled to the chill plate, the heat transfer member actuatable between a first position in which the second end is not in contact with the mold shell and a second position in which the second end is in contact with the mold shell, wherein the first end of the heat transfer member is coupled to the chill plate in both the first position and the second position.

10. The casting system as in claim 9, wherein the heat transfer member is composed of one or more of molybdenum alloy, high-melting point refractory alloy, graphite, silicon carbide, or a ceramic matrix composite silicon carbide.

11. The casting system as in claim 9, wherein the heat transfer member is composed of one or more of silica, alumina, zircon, zirconia, chromia, or yttria.

12. The casting system as in claim 9, wherein the heat transfer member includes an oxidation resistant coating.

13. The casting system as in claim 9, wherein the mold shell defines a shell thickness of between about 2 mm and about 25 mm.

14. The casting system as in claim 9, wherein the heat transfer member is a first heat transfer member, and wherein the system further comprises a second heat transfer member.

15. A casting system for forming a directionally-solidified casting component, the casting system comprising:

a chamber;

a baffle plate disposed within the chamber, the chamber and the baffle plate collectively defining a heating zone and a cooling zone, the heating zone and the cooling zone separated by the baffle plate;

a chill plate movable between the heating zone and the cooling zone;

a mold shell disposed on the chill plate; and a heat transfer member extending from a first end to a second end, the first end being coupled to the chamber, the heat transfer member actuatable between a first position in which the second end is not in contact with the mold shell and a second position in which the second end is in contact with the mold shell, wherein the first end of the heat transfer member is coupled to the chamber in both the first position and the second position.

16. The casting system as in claim 15, wherein the heat transfer member is composed of one or more of molybdenum alloy, high-melting point refractory alloy, graphite, silicon carbide, or a ceramic matrix composite silicon carbide.

17. The casting system as in claim 15, wherein the heat transfer member is composed of one or more of silica, alumina, zircon, zirconia, chromia, or yttria.

18. The casting system as in claim 15, wherein the heat transfer member includes an oxidation resistant coating.

19. The casting system as in claim 15, wherein the mold shell defines a shell thickness of between about 2 mm and about 25 mm.

20. The casting system as in claim 15, wherein the heat transfer member is a first heat transfer member, and wherein the system further comprises a second heat transfer member.

* * * * *